US009410667B2

(12) United States Patent
Opolka

(10) Patent No.: US 9,410,667 B2
(45) Date of Patent: Aug. 9, 2016

(54) FLASHLIGHT WITH ROTATABLE BATTERY CARTRIDGE

(75) Inventor: Rainer Opolka, Solingen (DE)

(73) Assignee: ZWEIBRUEDER OPTOELECTRONICS GMBH & CO. KG, Solingen (DE)

( * ) Notice: Subject to any disclaimer, the term of this patent is extended or adjusted under 35 U.S.C. 154(b) by 662 days.

(21) Appl. No.: 13/700,221

(22) PCT Filed: May 5, 2011

(86) PCT No.: PCT/DE2011/001029

§ 371 (c)(1),
(2), (4) Date: Feb. 11, 2013

(87) PCT Pub. No.: WO2012/006977

PCT Pub. Date: Jan. 19, 2012

(65) Prior Publication Data

US 2013/0147390 A1 Jun. 13, 2013

(30) Foreign Application Priority Data

Jul. 13, 2010 (DE) ..... 10 2010 026 918

(51) Int. Cl.

| | |
|---|---|
| ***F21V 1/00*** | (2006.01) |
| ***F21L 4/02*** | (2006.01) |
| ***F21V 23/04*** | (2006.01) |
| *F21Y 101/02* | (2006.01) |
| *F21Y 113/00* | (2016.01) |

(52) U.S. Cl.

CPC ..... *F21L 15/02* (2013.01); *F21L 4/027* (2013.01); *F21V 23/0414* (2013.01); *F21Y 2101/02* (2013.01); *F21Y 2113/005* (2013.01)

(58) Field of Classification Search

CPC ..... F21L 4/00; F21L 4/027; F21V 23/0414
USPC ..... 362/170, 184, 203, 208
See application file for complete search history.

(56) References Cited

U.S. PATENT DOCUMENTS

| | | | | |
|---|---|---|---|---|
| 7,023,004 | B2 | 4/2006 | Ford | |
| 7,220,016 | B2 | 5/2007 | Matthews | |
| 7,784,963 | B2 | 8/2010 | Galli | |
| 2001/0015893 | A1 * | 8/2001 | Campman | 362/184 |

FOREIGN PATENT DOCUMENTS

| | | | |
|---|---|---|---|
| FR | 683667 | B | 3/1930 |
| GB | 561616 | A | 5/1944 |
| WO | 0045086 | A | 8/2000 |

* cited by examiner

*Primary Examiner* — Karabi Guharay
(74) *Attorney, Agent, or Firm* — Andrew Wilford

(57) ABSTRACT

The present invention relates to a flashlight having a rotary switch for switching different brightness levels and/or luminous colors, which rotary switch has a battery cartridge arranged rotatably in a flashlight housing and having spring-mounted electrical contacts arranged at the end, which electrical contacts are each connected to an electrical contact face or an electrical contact zone of a contact plate. In order to provide a switchover option for a flashlight with different switching steps that has a simple design, is light and can be operated reliably, the invention proposes that the battery cartridge is held securely in the flashlight housing by a fixing sleeve and that the battery cartridge is rotated in the flashlight housing by a rotary button that passes longitudinally axially through the fixing sleeve.

8 Claims, 2 Drawing Sheets

FLASHLIGHT WITH ROTATABLE BATTERY CARTRIDGE

CROSS REFERENCE TO RELATED APPLICATIONS

This application is the US-national stage of PCT application PCT/DE2011/001029 filed 5 May 2011 and claiming the priority of German patent application 102010026918.2 itself filed 13 Jul. 2010.

FIELD OF THE INVENTION

The invention relates to a flashlight having a rotary switch for switching different brightness levels and/or luminous colors, a battery cartridge rotatable in a flashlight housing, and spring-mounted electrical contacts at the end and each connected to an electrical contact face or an electrical contact zone of a contact plate.

BACKGROUND OF THE INVENTION

In recent years, conventional flashlights with an incandescent bulb have increasingly been replaced by flashlights having light-emitting diodes (LEDs). The advantage of an LED consists in particular in the lower consumption of electricity in comparison with the incandescent bulb, the impact and shock resistance and a much longer life. This is due at least to the fact that, in contrast to an incandescent bulb, the greater part of the energy supplied is converted directly into light and not into heat.

Meanwhile, different light-emitting diodes are also known that have different brightnesses and/or can output light in different colors. In addition, LED chips on a contact plate, so-called chips on boards, are also known, even in variants where different LEDs are provided on a mount.

In order to switch the light-emitting diode or light-emitting diodes to a greater brightness or to a different color mix, it is necessary to activate different circuits with different voltages, for which purpose mechanical step switches are known that close different or else additional contacts, depending on the switching step. The disadvantage of such step switches consists in their relatively high level of susceptibility to wear and the sometimes notched guides, so that it is not possible to rule out the possibility of jamming. Depending on the quality of the compression spring used and of the detachable latching elements, undesired faulty switching operations likewise cannot be ruled out.

In addition to such step switches, rotary switches are also known. For example, WO 2000/045086 describes a tubular flashlight with a light source at each end of the flashlight. The flashlight comprises two parts that are rotatable with respect to one another. One part of the flashlight is connected to a battery cartridge, with a segmented contact plate being fastened to the end of the battery cartridge, the segmented contact plate bearing against fixedly mounted electrical contacts of the other part. By rotation of the battery cartridge, the electrical contacts can be connected to different contact faces and can therefore close different circuits.

One disadvantage with the described construction consists in that the flashlight parts are only plugged together and can therefore be withdrawn easily from one another, whereupon they will cease to function.

OBJECT OF THE INVENTION

An object of the present invention therefore consists in providing a switchover option for a flashlight with different switching steps that has a simple design, is light and can be operated reliably. In particular, such a flashlight should have a robust configuration and should also function reliably during robust use.

SUMMARY OF THE INVENTION

This object is achieved by the flashlight according to the invention provides in that the battery cartridge is held securely in the flashlight housing by a fixing sleeve and can be rotated in the flashlight housing by a rotary knob that passes longitudinally axially through the fixing sleeve. Such a flashlight has a simple and at the same time robust configuration, despite having a rotary switch.

A first preferred embodiment of the invention provides that the contact plate has, on one side, a centrally arranged electrical contact face and a plurality of electrical contact zones spaced radially apart from the contact face. However, other configurations are also conceivable. For example, the electrical contact face could be configured in the form of a ring or part of a ring, in which case it is only necessary to take care to ensure that the corresponding electrical contact is arranged in such a way that it remains in a bearing arrangement with the contact face on rotation of the battery cartridge. At least one LED is preferably provided on the other side of the contact plate.

The basic concept of the present invention relates to a flashlight with different switching states. In order to make this possible, the contact zones are connected to different electrical resistors or different LEDs, with the result that the choice of the circuit-closing contact zone and the function of the flashlight can be fixed. In order that no current flow is produced between the individual contact zones, the electrical contact faces and the electrical contact zones are isolated from one another by insulating webs. In accordance with a preferred embodiment of the invention, one spring-mounted electrical contact is connected electrically so as to touch the centrally arranged contact face and the other electrical contact is connected to one of the radially spaced-apart contact zones. However, the specific position and shape of the contact face and the contact zones is not of critical importance ultimately. Instead, the important factor is that the contacts are connected to the contact face or the desired contact zone even during rotation of the battery cartridge.

In order to impart the desired stability to the flashlight in the assembled state in order that it remains reliably functional even during robust use, the battery cartridge is held securely in the flashlight housing. Preferably, for this purpose, it has a rear ring-shaped stop face and a threaded section, and the fixing sleeve has complementary stop faces and a threaded section that connect it to the flashlight housing. Finally, the rotary knob is connected to the battery cartridge via a threaded section so the battery cartridge can be rotated in the flashlight housing via the threaded section. In the installed state, the rotary knob passes longitudinally axially through the fixing sleeve.

A further preferred configuration of the present invention is that the battery cartridge has a pressure-operated switch operatively connected to a pushbutton in the rotary knob. This additional pressure-operated switch makes it possible for the user to select the desired switching function of the flashlight in the switched-off state by rotating the battery cartridge and to switch on this function via the pressure-operated switch. Furthermore, the pressure-operated switch makes it possible to prevent the flashlight from switching on as a result of unintentional rotation of the rotary knob that can easily take place, for example, during transport in a rucksack or a bag.

BRIEF DESCRIPTION OF THE DRAWING

Further preferred embodiments and specific configurations of the invention will be described below with reference to the figures, in which.

SPECIFIC DESCRIPTION OF THE INVENTION

Figure 1:
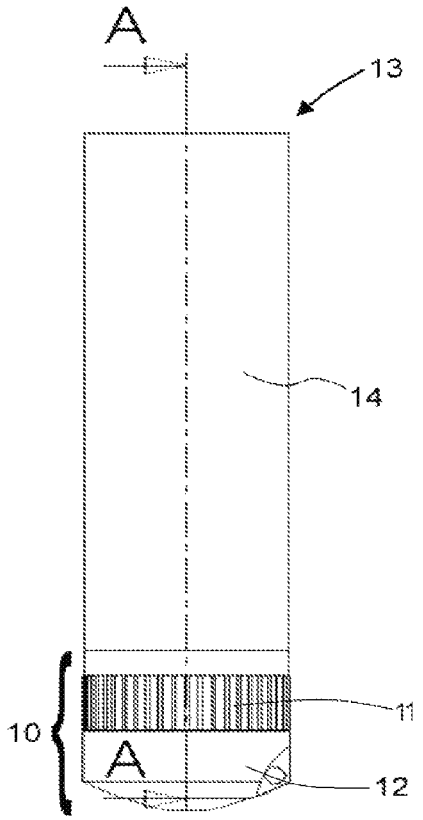
FIG. 1 is a side view of a flashlight.
Figure 2:
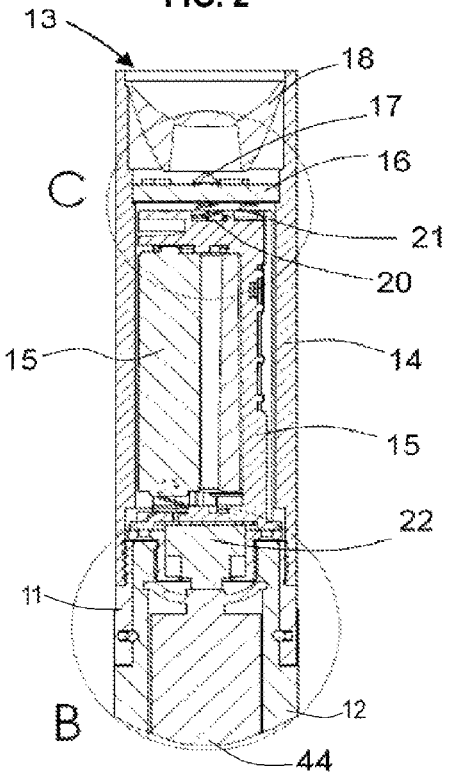
FIG. 2 is a longitudinal section through the flashlight shown in FIG. 1 along the line A-A.
Figure 3:
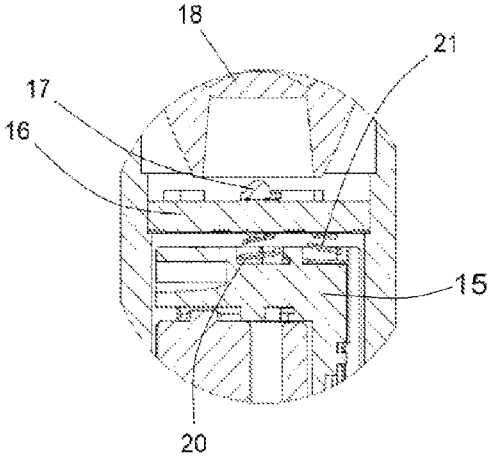
FIGS. 3 and 4 are views of the details C and B in FIG. 2.

The flashlight illustrated in the figures has a cylindrical shape with an end cap 10 that can be screwed on, is fixed detachably at the rear end and is formed from a fixing sleeve 11 and a rotary knob 12, and with a front open end 13 forming a light exit surface. At least one battery or battery stack or battery cartridge 15 that accommodates a plurality of series-connected batteries, is provided inside a flashlight housing 14. In addition, the flashlight has a contact plate 16 with at least one LED 17. When using a single LED 17, different colors and/or different brightnesses can be emitted depending on the voltage drop across the LED 17.

In addition, the flashlight has an auxiliary optical element 18 that is a reflector lens so that radiation emitted in the center is incident on the inner focusing lens part and is focused there so as to produce parallel light while laterally emitted rays are incident on a conical surface and an outer reflector surface whence they are likewise emitted toward the open end 13.

Figure 5:
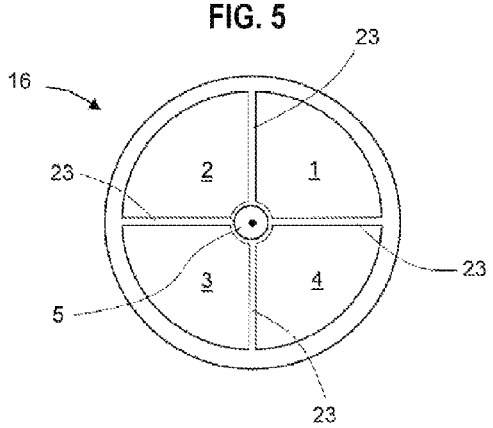
FIG. 5 shows the underside of a disk-shaped contact plate with four contact zones and one contact face.
Figure 6:
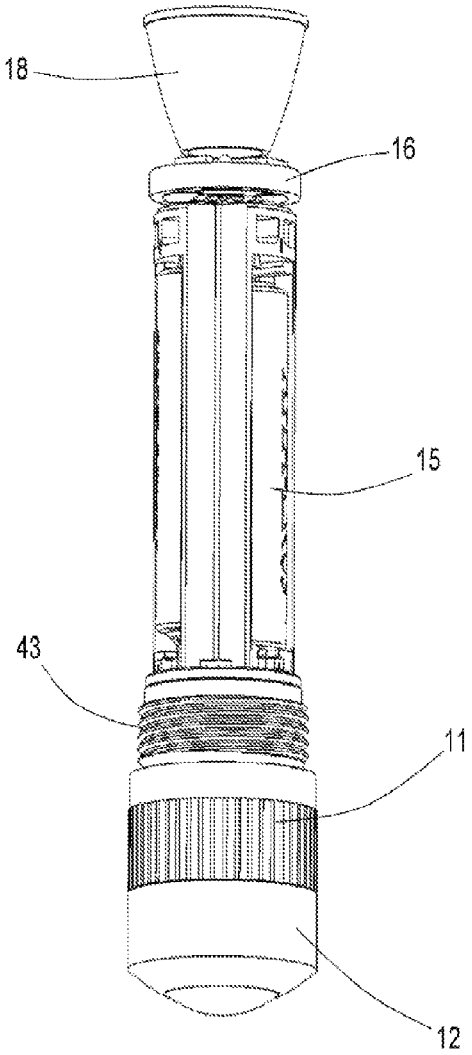
FIG. 6 is a schematic view of a lamp head with an auxiliary optical element, a chip on board and a battery cartridge held on an end cap.

According to the invention, the flashlight has a rotary switch that in the present case is formed by the contact plate 16, the battery cartridge 15 and the rotary knob 12. Here, the battery cartridge 15 has a first central spring contact 20 electrically connected to a central contact 5, and an off-center contact spring 21 that, together with the rotatable battery cartridge 15, sweeps over different electrical contact zones 1, 2, 3, 4 on a back face of the contact plate 16. When using a battery stack without a battery cartridge 15 or when using a single battery, the central contact 5 can also be formed by the positive terminal of the battery. The contact spring 21 can, as illustrated in principle in FIG. 5, make contact with one of the contact zones 1, 2, 3, 4 that each provide different switching option. Insulating webs 23 (FIG. 5) are provided between the contact zones 1 to 4 and prevent faulty switching operations as a result of the contact spring 21 simultaneously touching two of contact zones 1-4.

The switching options are as extensive as desired and are only limited by the fact that the contact spring 21 needs to rest securely on one of the contact zones 1, 2, 3, 4 to effect a defined switching state. By using additional elements or further control circuits, blinking functions can also be realized in addition to different diodes or diode groups and different voltages being switched on.

In addition, the flashlight illustrated has a pressure-operated switch 22 so that the desired switching function can also be selected in the switched-off state.

Figure 4:
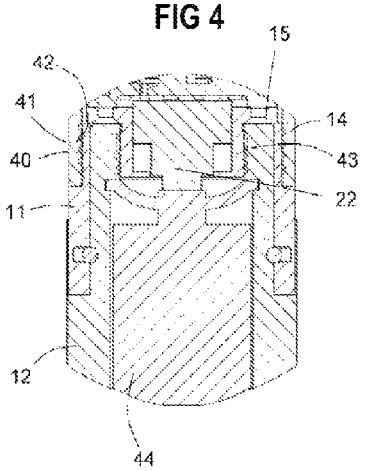

The secure holding of the battery cartridge 15 within the flashlight housing 14 is illustrated in the detail view of FIG. 4. In this regard, the flashlight housing 14 has a threaded section 40 onto which the fixing sleeve 11 is screwed. The fixing sleeve 11 has a bearing face 41 engaging a bearing face 42 of the battery cartridge 15 and securing the battery cartridge 15 in the flashlight housing 14. Furthermore, the battery cartridge 15 is connected to the rotary knob 12 via a threaded section 43, and the rotary knob 12 extends axially through the fixing sleeve 11. In the illustrated case, a pushbutton 44 connected to the pressure-operated switch 22 of the battery cartridge 15 is located within the rotary knob 12.

The invention claimed is:

1. A flashlight comprising:

a tubular housing extending along an axis and having axially opposite front and rear ends;

a contact plate fixed in the housing forward of the rear end and having a rear face carrying an axially rearwardly directed contact face and a plurality of axially rearwardly directed contact zones juxtaposed therewith;

a battery cartridge in the housing having two forwardly projecting spring contacts engaging the contact face and at least one of the contact zones of the contact plate, the cartridge being rotatable in the housing about the axis to engage the zones one at a time with one of the spring contacts;

a fixing sleeve threaded to the rear end and having an axially forwardly directed bearing face forwardly engaging the cartridge, pressing the spring contacts against the contact plate, and retaining the cartridge in the housing; and a rotary knob on the rear end of the housing, rotatable on the housing about the axis, and engaging through the fixing sleeve with the cartridge for joint rotation therewith such that rotation of the knob rotates the cartridge and sweeps the one contact over the contact zones.

2. The flashlight as claimed in claim 1, wherein the contact face is axially centrally located on the back face of the contact plate and the plurality of electrical contact zones are spaced radially apart from and angularly around the contact face.

3. The flashlight as claimed in claim 2, further comprising:

at least one LED is arranged on a front face of the contact plate.

4. The flashlight as claimed in claim 1, wherein the electrical contact face and the electrical contact zones are isolated from one another by insulating webs.

5. The flashlight as claimed in claim 1, wherein the other spring contact is in constant electrically contact with the contact face.

6. The flashlight as claimed in claim 1, wherein the battery cartridge has an annular and axially rearwardly directed stop engaging the bearing face of the fixing sleeve face and a threaded section at the rear end.

7. The flashlight as claimed in claim 6, wherein the rotary knob is connected to the battery cartridge via the threaded section.

8. The flashlight as claimed in claim 1, wherein the battery cartridge carries a pressure-operated switch that is operatively connected to a pushbutton arranged in the rotary knob.

* * * * *